US005868688A

United States Patent [19]

Avidor et al.

[11] Patent Number: 5,868,688

[45] Date of Patent: Feb. 9, 1999

[54] FOOT MASSAGING APPLIANCE

[75] Inventors: Joseph Avidor, Ramat Hasharon; Igal Benbasat, Ramat Gan; Nitza Kardish, Tel Aviv, all of Israel

[73] Assignee: Yonitech Laboratories Ltd., Ramat-Gan, Israel

[21] Appl. No.: 589,458

[22] Filed: Jan. 22, 1996

[51] Int. Cl.[6] ..... A61H 15/00; A61H 15/02; A61H 23/00

[52] U.S. Cl. ..... 601/87; 601/103; 601/102; 601/104; 601/112; 601/122; 601/127; 601/22; 601/19

[58] Field of Search ..... 601/18–22, 27–32, 601/61, 63–65, 70, 85–87, 89, 93–95, 97, 99–104, 112, 113, 122, 126, 127

[56] References Cited

U.S. PATENT DOCUMENTS

| | | | |
|---|---|---|---|
| 745,128 | 11/1903 | Williams | 601/20 |
| 1,577,751 | 3/1926 | Paschall | 601/112 |
| 1,624,133 | 4/1927 | Cheney | 601/112 |
| 2,146,320 | 1/1939 | Jones | 601/112 |
| 2,430,414 | 11/1947 | Stern | 601/62 |
| 2,553,873 | 5/1951 | Schwebel | 601/20 |
| 2,914,065 | 11/1959 | Cory | 601/112 |
| 3,678,924 | 7/1972 | Fujimoto | 601/87 |
| 4,014,325 | 3/1977 | Clarke . | |
| 4,378,007 | 3/1983 | Kachadourian . | |
| 4,777,945 | 10/1988 | Curtaz et al. . | |
| 5,573,500 | 11/1996 | Katsunuma et al. | 601/103 X |
| 5,695,451 | 12/1997 | Kawakami | 601/84 |

FOREIGN PATENT DOCUMENTS

| | | | |
|---|---|---|---|
| 18489/83 | 1/1984 | Australia . | |
| 138889 | 10/1934 | Austria | 601/101 |
| 2590480 | 11/1985 | France . | |
| 3423045 | 1/1986 | Germany . | |
| 4114330 | 10/1992 | Japan | 601/112 |
| 405285190 | 11/1993 | Japan | 601/22 |
| 2008880 | 3/1994 | Russian Federation . | |
| 593684 | 4/1976 | Switzerland . | |
| 652021 | 10/1985 | Switzerland . | |
| 1388040 | 4/1988 | U.S.S.R. . | |
| 2280855 | 3/1993 | United Kingdom . | |

*Primary Examiner*—Danton D. DeMille
*Attorney, Agent, or Firm*—Mark M. Friedman

[57] ABSTRACT

A foot massaging appliance, includes a housing adapted to be supported on a flat horizontal surface and including an upper face facing upwardly of the housing when so supported; at least one massaging unit mounted within the housing for cyclical movement and including a plurality of massaging elements projecting upwardly from the upper face thereof for massaging the sole of a user's foot when placed thereon; and a motor drive for cyclically moving the massaging unit.

6 Claims, 8 Drawing Sheets

FIG.6
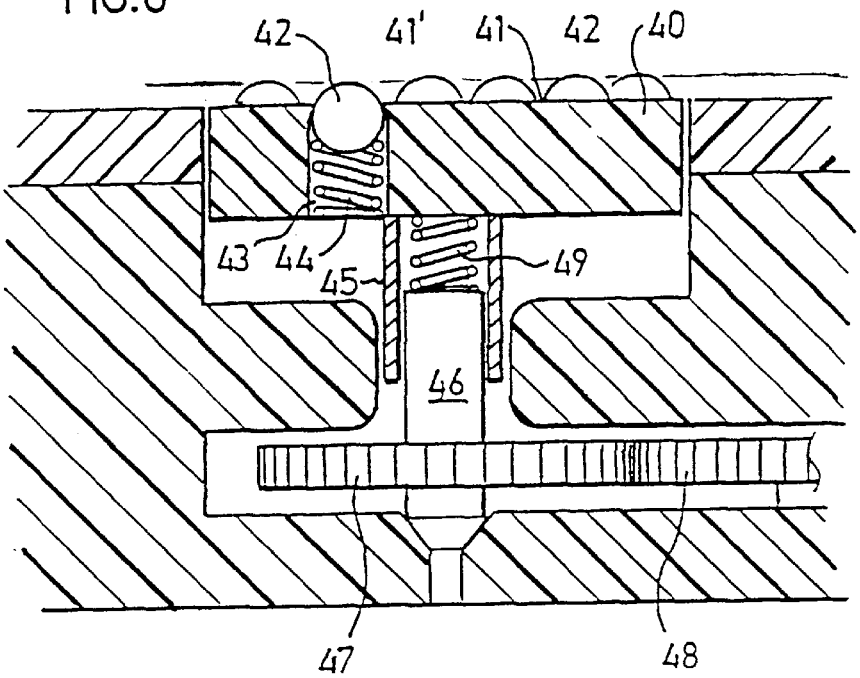
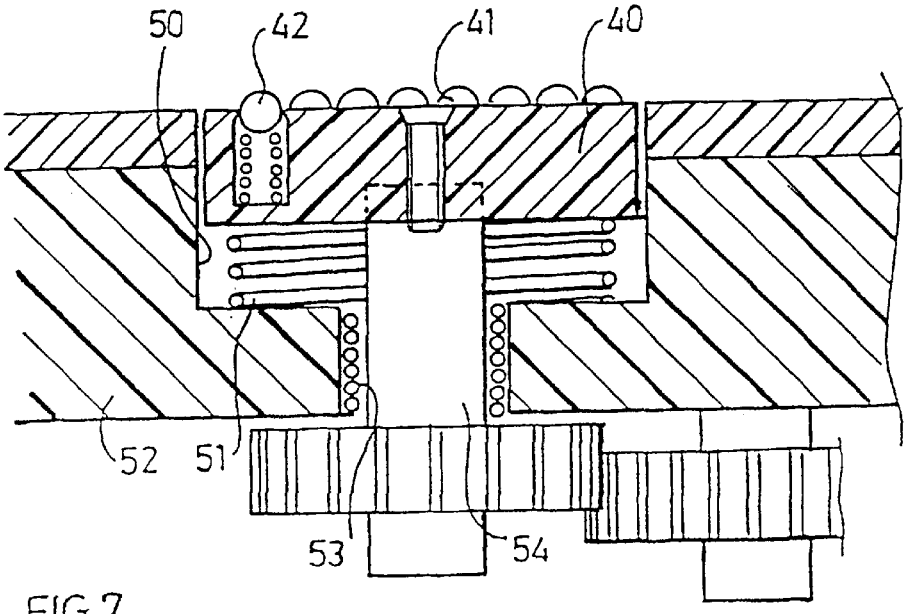
FIG.7

FIG. 8
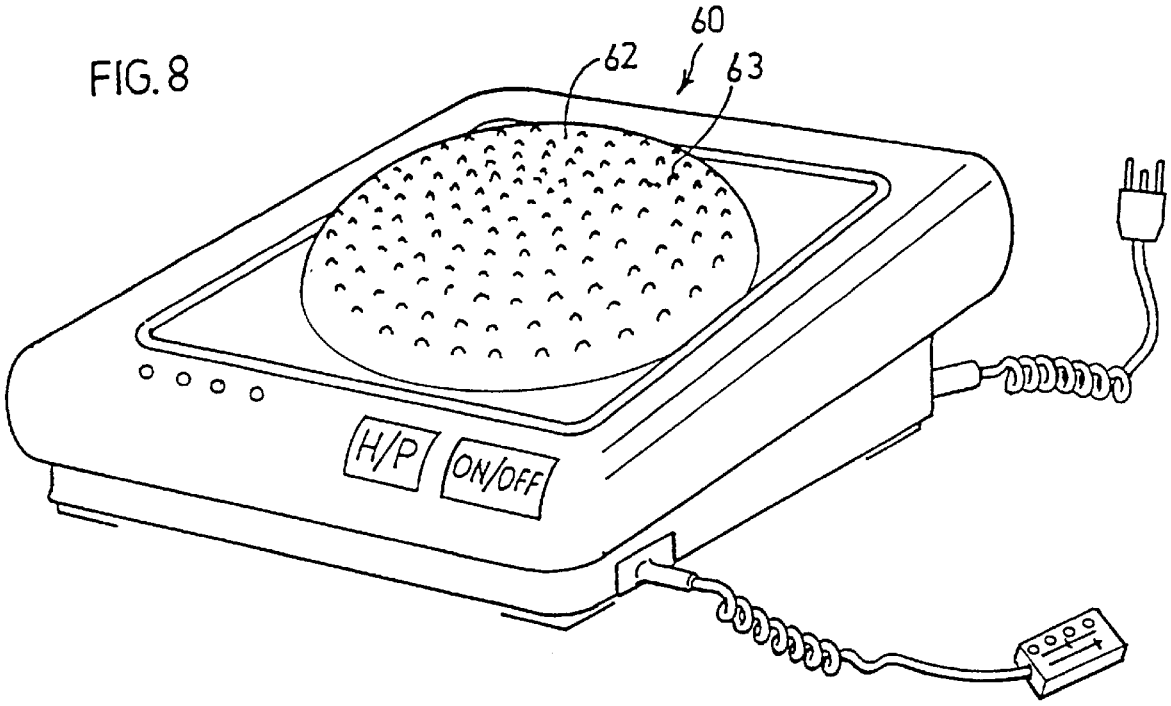
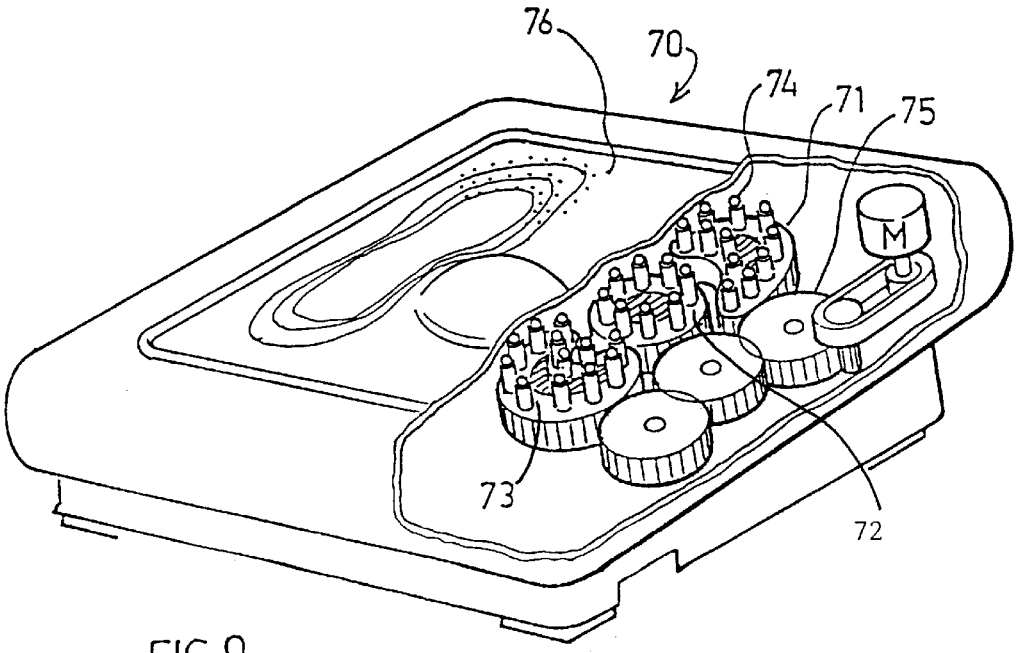
FIG 9

FIG 12
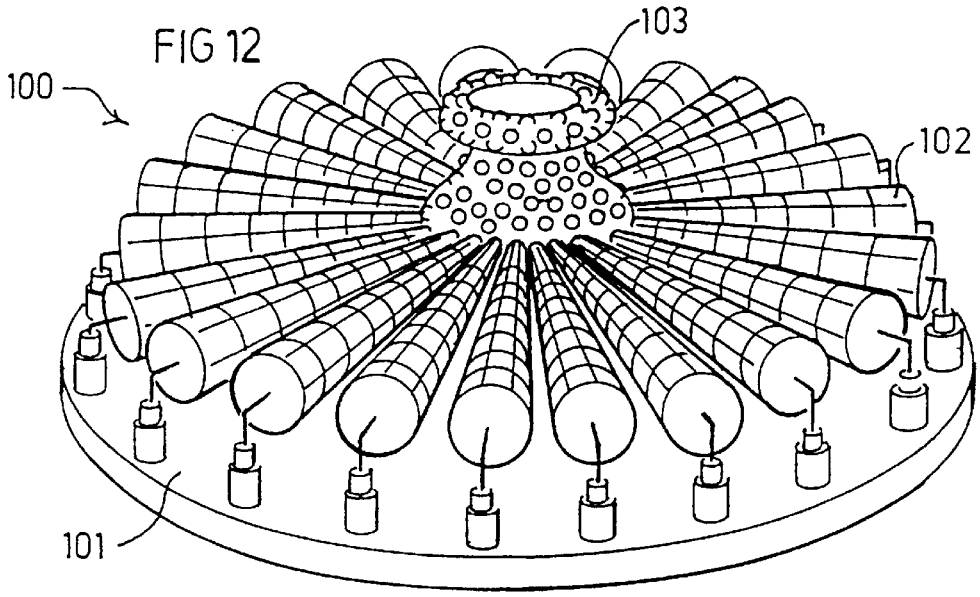
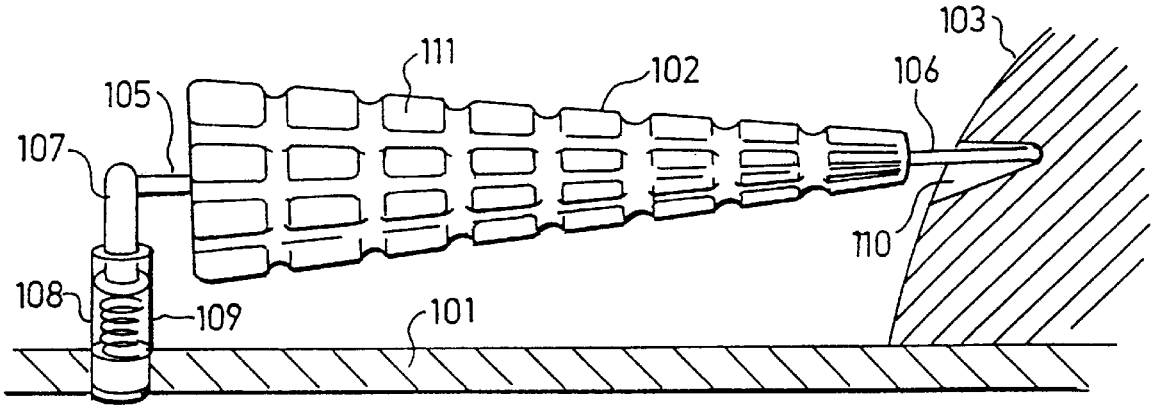
FIG 13
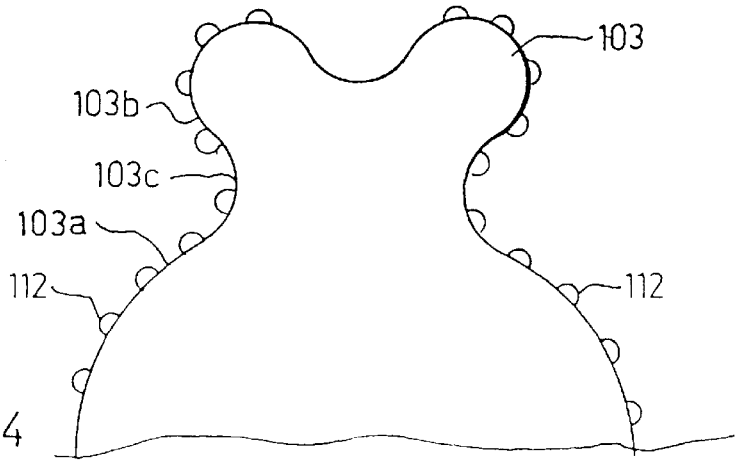
FIG 14

FOOT MASSAGING APPLIANCE

FIELD AND BACKGROUND OF THE INVENTION

The present invention relates to a foot massaging appliance for massaging a user's feet, e.g., in order to promote blood circulation, to relieve aches, pains and tension and/or to remove excess fluid. While the foot massaging appliance of the present invention is useful for general application, it is particularly designed for use by diabetics to counter degeneration of blood vessels and/or nerves to which diabetics are particularly susceptible.

The therapeutic value of massage for promoting blood circulation in the feet and other parts of the human body is well known, and many massaging appliances have been developed for this purpose.

OBJECTS AND BRIEF SUMMARY OF THE INVENTION

An object of the present invention is to provide a novel foot massaging appliance which can be used in a convenient and efficient manner for massaging the soles of a user's feet, and which, optionally, can also be used for applying heat and/or electrical stimulation, to the user's feet at the time of the massage. Such an appliance can advantageously be used by the general public for relieving aches, pains and tension, but is particularly designed for use by diabetics, for reducing or preventing degeneration of the blood vessels and/or nerves in the feet of diabetics.

According to the present invention, there is provided a foot massaging appliance, comprising: a housing adapted to be supported on a flat horizontal surface and including an upper face facing upwardly of the housing when so supported; at least one massaging unit mounted within the housing for cyclical movement and including a plurality of massaging elements projecting upwardly from the upper face thereof for massaging the sole of a user's foot when placed thereon; and a motor drive for cyclically moving the massaging unit.

According to further features in a described preferred embodiment, the upper face of the massaging unit is substantially flat, and the massaging elements are of substantially semi-spherical configuration. The massaging elements may be integrally formed with the upper face of the massaging unit, or they may be spring-urged outwardly from the upper face of the massaging unit.

According to still further features in described preferred embodiments, the housing includes a plurality of massaging units rotatably mounted within the housing, each having a plurality of massaging elements projecting from an upper face of the respective massaging unit. In the described embodiment, the plurality of massaging units include a first group on one side of the upper face of the housing for massaging the sole of one foot of the user, a second group on the opposite side of the upper face of the housing for massaging the sole of the other foot of the user, and a central massaging unit between the first and second group for massaging the arches of the two feet.

According to still further features in the described preferred embodiments, the massaging appliance further includes a separable pliable sheet overlying the massaging units for receiving the user's foot and conformable to the outer contour of the user's foot and of the outer face of the massaging units. In one described preferred embodiment, the pliable sheet includes an electrical heating element for heating the sole of the user's foot when received thereon, and a plurality of electrodes exposed for contacting the sole of the user's foot for applying electrical pulses thereto. We have found the application of heat at the time of massage to be particularly effective in the massage treatment especially for use by diabetics. In addition, the application of the electrical pulses produces a "tingling" effect at the time of the massage treatment, similar to the "electro-acupuncture" devices presently used for relieving aches, pains and tensions, which we have also found to be particularly effective particularly for use by diabetics.

Further features and advantages of the invention will be apparent from the description below.

BRIEF DESCRIPTION OF THE DRAWINGS

The invention is herein described, by way of example only, with reference to the accompanying drawings, wherein:

FIG. 6 is a transverse sectional view more particularly illustrating the construction of one of the massaging units in the appliance of FIGS. 1 and 2;

FIG. 7. is a view similar to that of FIG. 6 but illustrating a variation;

FIGS. 8 and 9 illustrate other forms of foot massaging appliances constructed in accordance with the present invention;

FIG. 12 illustrates a further form of foot massaging appliance constructed in accordance with the present invention;

FIG. 13 is an enlarged side elevational view more particularly illustrating the construction of one of the radially-extending massaging elements in the massaging appliance of FIG. 12;

and FIG. 14 is a side elevational view more particularly illustrating the central massaging element in the massaging appliance of FIG. 12.

DESCRIPTION OF PREFERRED EMBODIMENTS

Figure 1:
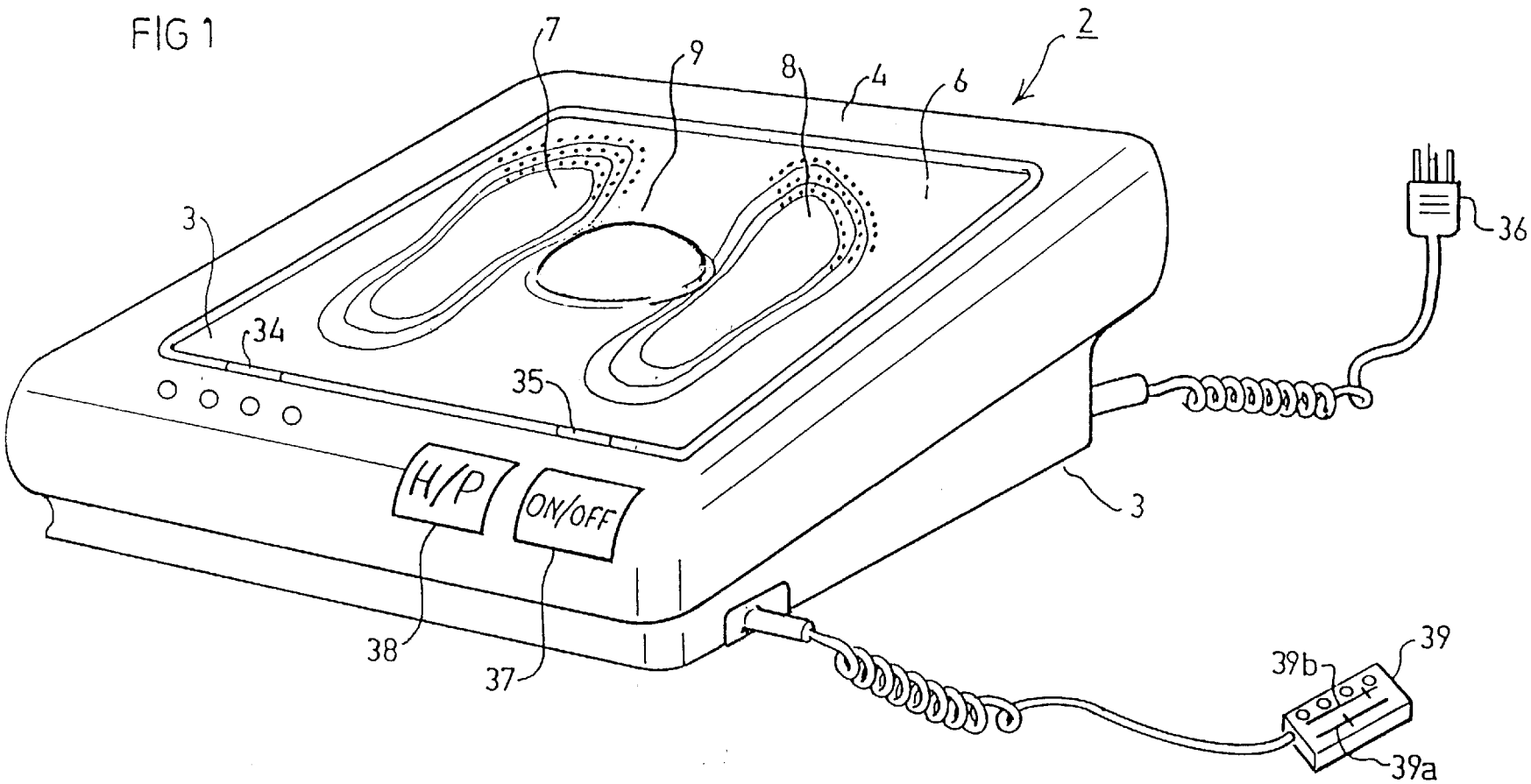
FIG. 1 is a three-dimensional view illustrating one form of foot massaging appliance constructed in accordance with the present invention.

The massaging unit illustrated in the drawings comprises a housing 2 having a flat base 3 for supporting the appliance on a flat horizontal surface, such as the floor or a footstool. The upper face 4 of the housing is formed with a rectangular cavity 5 (FIG. 2) in which are located a plurality of massaging units to be described more particularly below.

Cavity 5 containing the massaging units is covered by a removable sheet 6 of a pliable sheet material (e.g., plastic, natural or synthetic rubber, etc.), enabling it to conform to the contour of the massaging units 11–17 within cavity 5, and also to the contour of the sole of the user's foot when placed thereon. Pliable sheet 6 is marked to define recesses 7 and 8 corresponding to the outer shape of the user's left and right feet, respectively, and preformed with a central dome-shaped, or semi-spherical, projection 9, for a purpose to be described below.

Figure 2:
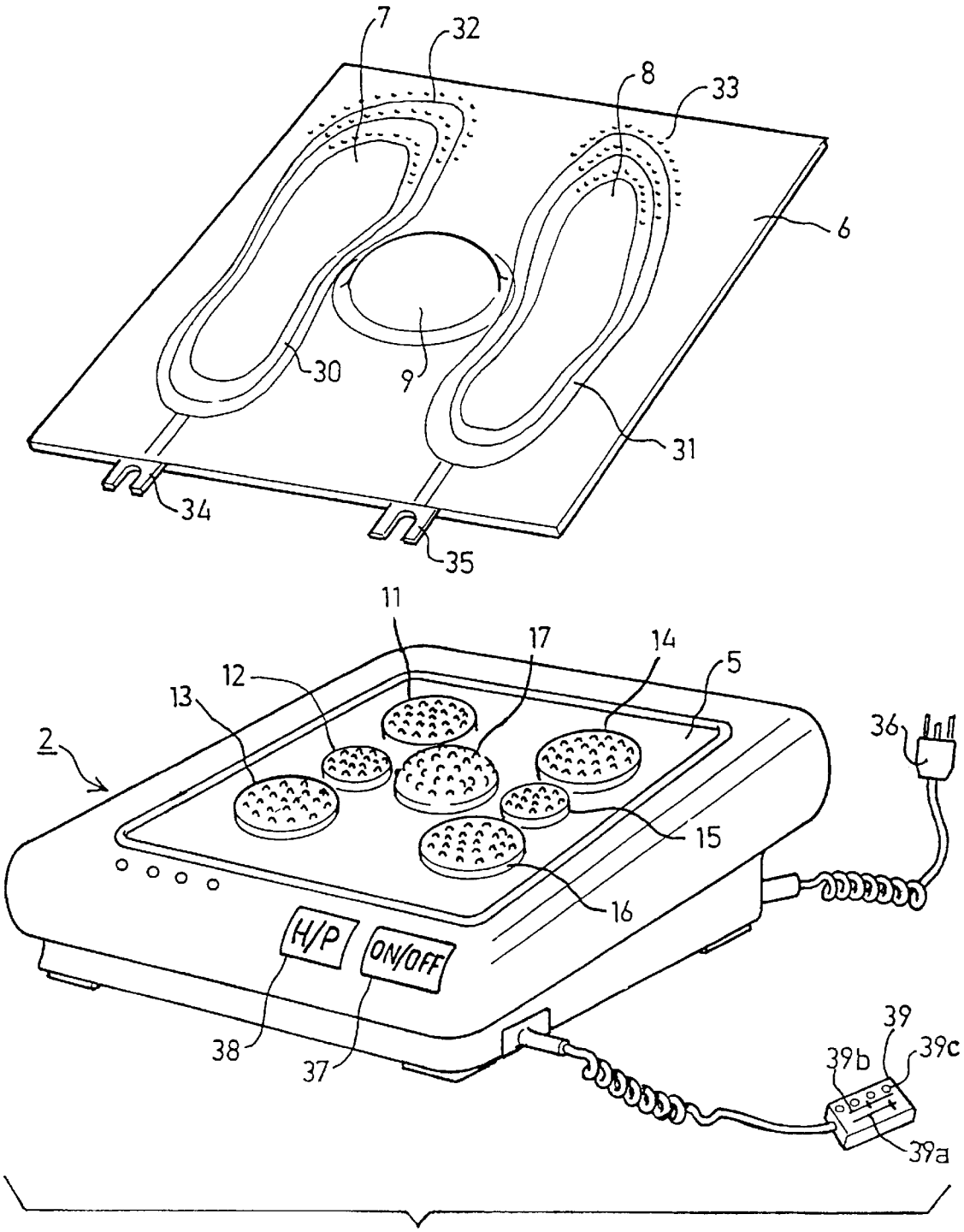
FIG. 2 is an exploded view illustrating the two main components in the appliance of FIG. 1.

As shown particularly in FIG. 2, there are seven massaging units 11–17 within cavity 5 of the appliance housing 2. These massaging units are arranged into: a first group of units 11–13 on one side of cavity 5 covered by foot recess 7 of the overlying pliable sheet 6; a second group of units 14–16 on the opposite side of cavity 5 and covered by the foot recess 8 of the overlying sheet 6; and a single central massaging unit 17 between the two groups, to be covered by the dome-shaped projection 9 of the overlying sheet 6. Massaging units 11–13 for massaging the soles of the user's left foot are of the same construction as massaging units 14–16 for massaging the soles of the user's right foot. The central massaging unit 17, however, is used for massaging the arches of the two feet of the user, and is therefore of somewhat different construction.

With respect to the left foot massaging units 11–13, it will be seen that the two outer massaging units 11 and 13 are of the same outer diameter, whereas the middle massaging unit 12 is of smaller diameter. All three massaging units 11–13 are of disc configuration, having flat upper faces 20 and a plurality of semi-spherical projections 21 integrally formed with and projecting from the upper faces 20. The upper face of the central massaging unit 17, however, is of dome-shaped or semi-spherical configuration, as best seen in FIG. 4, and is also formed with a plurality of semi-spherical massaging elements 22 projecting from its upper face.

Figure 4:
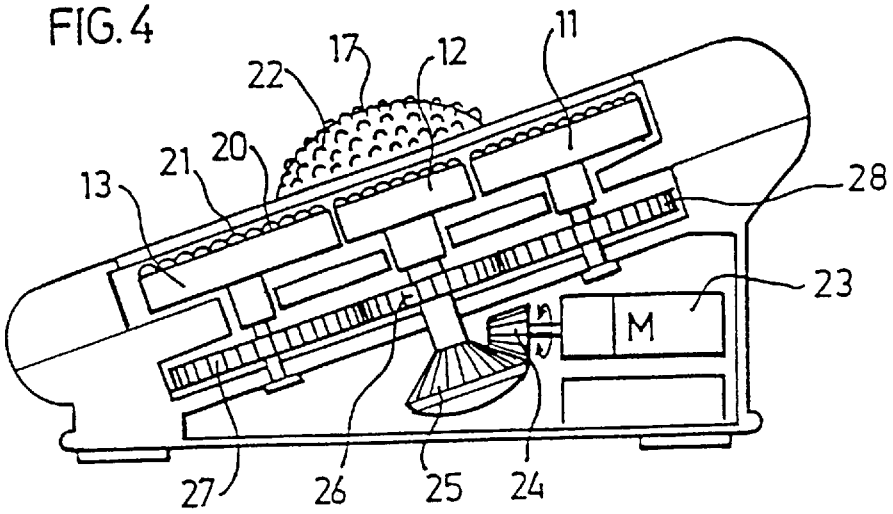
FIG. 4 is a transverse sectional view illustrating the manner in which the massaging units in the appliance of FIGS. 1 and 2 are rotated or oscillated.

All massaging units 11–17 are rotated by a common motor drive 23 which includes gearing, shown at 24–28 (FIG. 4). This gearing rotates all the massaging units simultaneously about their respective rotary axes passing centrally of the unit. Motor drive 23 may be operated to rotate all the massaging units continuously in one direction, but preferably it is operated (e.g., by controlling the direction of rotation of the motor, or of its gear transmission) to periodically reverse the rotation of the respective massaging units so that these units are oscillated back and forth around their respective axes.

The overlying pliable sheet 6 which covers all the massaging units 11–17 includes electrical heating elements or strips 30–31, in the foot-shaped recesses 7, 8, so as to enable heating the soles of the user's feet during a massage treatment. Sheet 6 also includes a plurality of electrode pins 32, 33, projecting upwardly from the foot-shaped recesses 7, 8 in the region to be occupied by the user's toes, to apply small-voltage electrical pulses thereto similar to the type of pulses applied by commercially-available "electro-acupuncture" devices for treating pain, aches or tensions. Pliable sheet 6 further includes a pair of plug-type terminals 34, 35, to be plugged into sockets in the housing 2 of the appliance (as shown in FIG. 1) for supplying electrical power to the heating strips 30, 31 and electrodes 32, 33.

The appliance as illustrated in FIG. 1 further includes an electrical plug 36 for connecting the appliance to a source of electrical energy. It also includes an ON/OFF switch 37, and a further switch 38 for energizing the heating strips 30, 31 and the electrodes 32, 33 in the overlying pliable sheet 6 if this is desired. The illustrated appliance further includes a remote control unit 39 having two slidable control elements 30*a*, 39*b* for controlling the heat and electrical pulses applied to the user's feet during the massage treatment, and a plurality of push buttons for selecting the motor speed. Optionally, it may also include an electrical interlock to prevent operation of the electrical motor 23 unless the overlying pliable sheet 6 is plugged, via its terminals 34, 35, into the housing 2, to prevent operation of the device unless and until the overlying sheet is in place.

Figure 3:
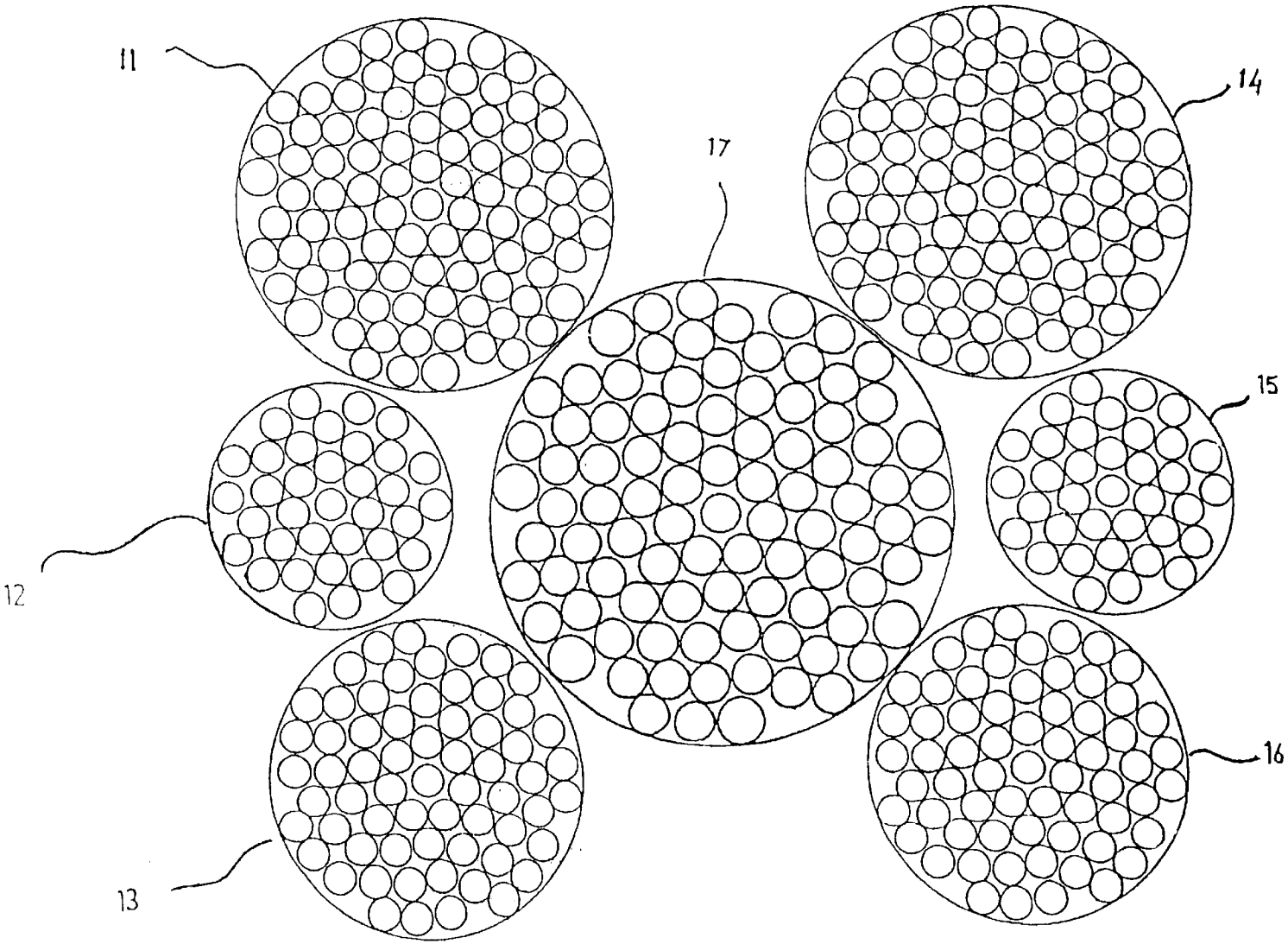
FIG. 3 is a plan view illustrating a variation in the arrangement of the massaging units in the appliance of FIGS. 1 and 2.

In FIG. 2, the three massaging units 11–13 and 14–16, respectively, in each of the two end groups of units, are shown as disposed in a substantially straight line. FIG. 3 illustrates a modification wherein the three units in each group, shown respectively as 11'–13' and 14'–16', are arranged according to a curvilinear line, wherein the central unit 12', 15', in each of the two groups is located outwardly of the other two units in the respective group, to more closely follow the bone structure of the respective foot. It will also be seen that in the modification illustrated in FIG. 3, the dome-shaped central massaging unit 17,' to operate on the arches of the user's feet, is of largest diameter; the two massaging units 11', 14', to operate on the balls of the user's feet are of slightly smaller diameter; the two massaging units 13', 16', to operate on the heel region of the user's feet are of slightly smaller diameter; and the two central units 12', 15', in each of the two end groups are of the smallest diameter.

The manner of using the massaging appliance illustrated in FIGS. 1–4 will be apparent from the above description. Thus, with the overlying sheet 6 placed over the massaging units 11–17, as shown in FIG. 1, the user places one or both feet in the respective feet recesses 7, 8 of the overlying sheet 6, and with the arches of the two feet engageable with the central dome-shaped projection 9 of sheet 6. The appliance may then be operated to rotate the massaging units 11–17, whereupon massaging units 11–13 massage the sole of the user's left foot, massaging units 14–16 massage the sole of the user's right foot, and massaging unit 17 massages the arches of both feet. During this massage treatment, the electrical heater elements 30, 31 can also be energized by remote control 39, and the amount of heat controlled by operator 39*a*. Similarly, the electrodes 32, 33 can be energized and controlled, to apply electrical voltage pulses to the user's feet, by operator 39*b* of remote controller 39. The motor speed can be controlled by push button 39*b* of that controller.

Figure 5:
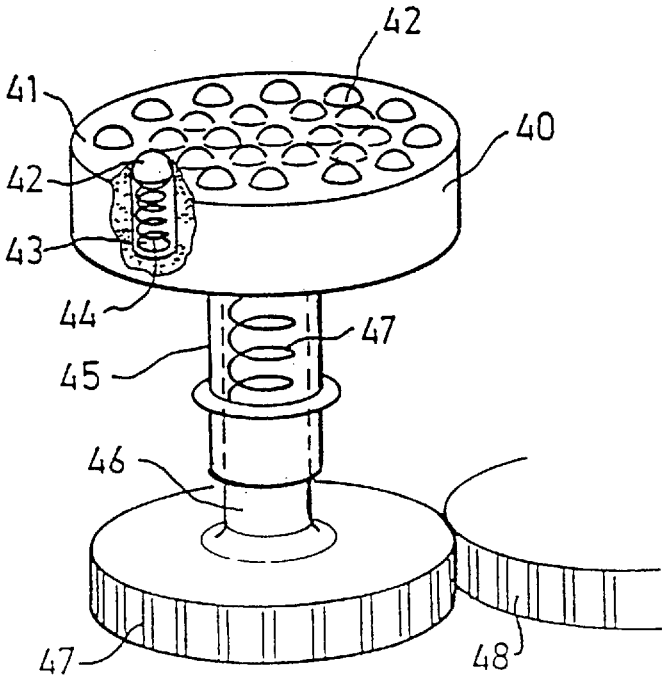
FIG. 5 is a three-dimensional view illustrating one of the massaging units in the appliance of FIGS. 1 and 2.

FIGS. 5 and 6 illustrate a variation in the construction of each of the massaging units 11–16. In this variation, the massaging unit, therein designated 40, is of circular configuration and is formed with a flat upper face 41 as described above. In this case, however, the projecting massaging elements 42 are not integrally formed with the upper face 41 of the massaging unit 40, but rather are separate elements received within sockets 43 formed in the massaging unit and urged outwardly thereof by springs 44.

Massaging unit 40 includes a hollow stem 45 coupled via a shaft 46 to a gear 47 to be rotated by the motor (e.g., 23, FIG. 4) within the housing via a gear 48. In this case, however, the massaging unit 40 is spring-urged outwardly by a spring 49 received within stem 45 and interposed between shaft 46 and the massaging unit 40. Hollow stem 45 is splined with respect to shaft 47 so that it is rotated by that shaft but is movable axially with respect thereto by spring 49.

FIG. 7 illustrates a further variation wherein the massaging unit 40 is received within a cavity 50 of the appliance and is spring urged outwardly by a spring 51 interposed between wall 52 of the housing defining cavity 50, and the massaging unit 40. In this case, a plurality of ball bearings 53 are interposed in the bore of housing 52 receiving stem 54 of the massaging unit 40, to permit the massaging unit to rotate by the rotation of its gear 47, and also to move axially inwardly and outwardly of the housing by its spring 51.

FIG. 8 illustrates another appliance, generally designated 60, including only a single massaging unit 62 of dome-shaped configuration and rotatably driven about its central axis. Massaging unit 62 is used for massaging the soles and arches of both feet of the user. It carries a plurality of massaging elements 63 on its outer face, preferably of semi-spherical configuration, which elements may be integrally formed with the outer surface of the massaging unit, or may be spring-urged with respect to the outer surface as described above. The appliance of FIG. 8 could also include an overlying pliable sheet, corresponding to sheet 6 in FIGS. 1 and 2.

FIG. 9 illustrates a further appliance, generally designated 70, similar to the appliance of FIGS. 1 and 2. In this case, however, instead of including the rotatable disc-type massaging units 11–16 in FIGS. 1 and 2, the appliance 70 in FIG. 9 includes massaging units in the form of closed flexible loops, as shown at 71, 72 and 73, each carrying a plurality of massaging elements at spaced locations along the respective loop. Each loop is driven by gearing, shown schematically at 75, and the massaging element 74 of this loop may be spring-urged balls as described above. FIG. 9 illustrates the appliance 70 as also including the outer pliable sheet, therein designated 76, corresponding to sheet 6 in FIGS. 1 and 2.

Figure 10:
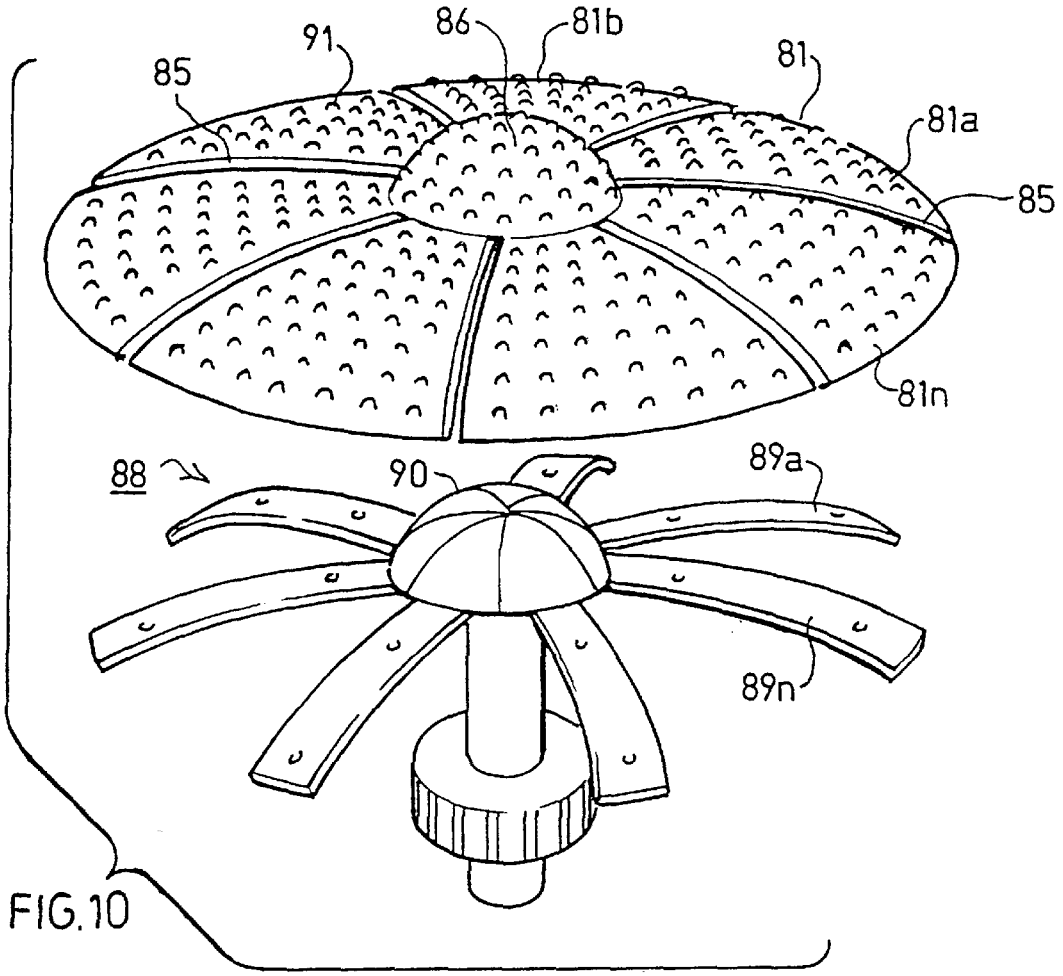
FIG. 10 is an exploded three-dimensional view illustrating another form of massaging appliance constructed in accordance with the present invention.
Figure 11:
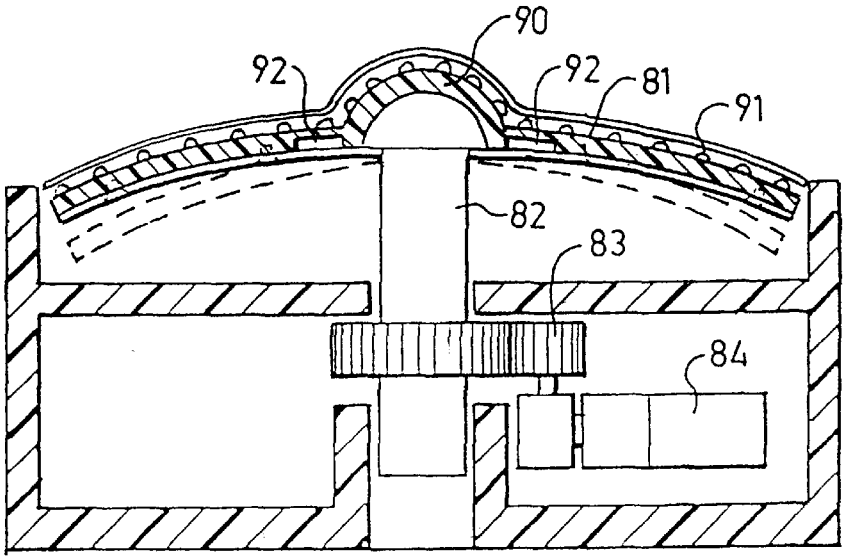
FIG. 11 is a sectional view of the appliance of FIG. 10.

FIGS. 10 and 11 illustrate another appliance, generally designated 80, including a single massaging unit 81 of circular configuration and rotatably mounted at its center by central shaft 82 coupled by gearing 83 to a motor drive 84. Massaging unit 81 is of stiff but flexible plastics material. It is formed with a plurality of radial slits 85 dividing the massaging unit into a plurality of flexible massaging sections 81*a*–81*n* radiating outwardly from a central dome-shaped section 86 integrally formed with the flexible sections.

A spring assembly, generally designated 88, underlies the massaging unit 81, and is formed with a plurality of radially-extending leaf springs 89*a*–89*n* engageable with the lower faces of the flexible massaging sections 81*a*–81*n*, respectively. Spring assembly 88 further includes a center dome section 90 underlying the center dome-section 86 of the massaging unit.

The outer faces of the flexible massaging sections 81*a*–81*n*, as well as of the center dome-shaped section 86, are formed with semi-spherical massaging projections 91.

As shown in FIG. 11, the radially-extending leaf springs 89*a*–89*n* engage the undersurfaces of the flexible massaging sections 81*a*–81*n* and urge them outwardly, so that these sections conform to the contour of the soles of the user's feet for massaging them as the massaging unit 81 is rotated by motor 84. The central dome-shaped section 186 may be used for massaging the arches of the user's feet.

To increase the elasticity of the flexible massaging sections 81*a*–81*n*, their junctures with the central dome-shaped section 86 may be of reduced thickness, as shown at 92 in FIG. 11. In this case, the spring assembly 88 may be omitted, and merely the inherent elasticity of the flexible massaging sections 81*a*–81*n* may be used for urging those sections against the soles of the user's feet so that they continuously conform to their contours.

FIGS. 12–14 illustrate a further appliance, generally designated 100, including a massaging unit in the form of a disc 101 rotatable about its central rotary axis by the motor (not shown). Rotary disc 101 includes a plurality of massaging elements 102 extending radially from the outer circumference of the disc towards it center, and a further massaging element 103 centrally of the disc.

Each of the massaging elements 102 is of conical configuration, increasing in diameter towards its outer end. Each is rotatably mounted about its own axis defined by extensions 105, 106 at its opposite ends. The outer extension 105 is rotatably mounted in the upper end of a rod 107 telescopingly received within a sleeve 108 fixed to disc 101. Rod 107 is urged outwardly of sleeve 108 by a spring 109, thereby providing a pressure-depressible mounting for that end of the massaging element.

The opposite end of massaging element 102 is rotatably mounted to the central massaging element 103 by extension 106 of massaging element 102 received within a recess 110 in massaging element 103. Recess 110 is dimensioned to permit end 106 of massaging element 102 to pivot within the recess during the displacement of rod 107 at its opposite end within sleeve 108. The outer surface of massaging element 102 is formed with projections 111 massaging the user's feet.

As shown particularly in FIG. 14, the central massaging element 103 has an outer contour simulating that of an hour-glass. Thus, it is formed with a lower converging section 103*a* joined to an upper converging section 103*b* at a waist section 103*c*, such that the user may place the bottom of the foot to be massaged against the outer surface of section 103*a*, and the upper surface of the foot to be massaged against the outer surface of the upper section 103*b*, to thereby massage both sections at the same time. The outer surface of massaging element 103 is also formed with massaging projections 112.

The appliance illustrated in FIGS. 12–14 may thus be used to massage the lower surface of the user's feet by placing it against the outer surface of the radially-extending massaging elements 102, such that as the disc 101 is rotated (by the motor, not shown), the user's foot will be successively engaged by the massaging elements 102. These elements rotate about their own individual axes, and also are pivotal, to thereby assure good contact of their outer projections 111 with the lower surfaces of the user's foot. The user may also massage both the lower surface and the upper surface of the foot by placing the foot in the waist portion 103*c* of the central massaging element 103, whereupon the outer surface of the lower section 103*a* will engage and massage the bottom of the user's foot, whereas the outer surface of the upper section 103*b* will engage and massage the upper surface of the user's foot.

While the invention has been described with respect to several preferred embodiments, it will be appreciated that these are set forth merely for purposes of example, and that many variations may be made. For example, the appliance could also include magnets, or electromagnets for treating the body according to other known devices or techniques. Many other variations, modifications and applications of the invention will be apparent.

We claim:

1. A foot massaging appliance comprising:

a housing adapted to be supported on a flat horizontal surface and including an upper face facing upwardly of the housing when so supported;

at least one massaging unit mounted within the housing for cyclical movement and including a plurality of massaging elements projecting upwardly from the upper face thereof for massaging the sole of a user's foot when placed thereon;

and a motor drive for cyclically moving said massaging unit, wherein said at least one massaging unit is of circular configuration, is rotatably mounted at its center, and is formed with a plurality of radial slits defining a plurality of flexible sections adapted to conform to the contour of the sole of the user's foot.

2. The appliance according to claim 1, wherein there are a plurality of radially-extending leaf springs engageable with said plurality of flexible sections of the massaging unit and urging said sections outwardly.

3. The appliance according to claim 1, wherein said massaging unit includes an unslitted dome-shaped center section integrally joined to said flexible sections.

4. A foot massaging appliance comprising:

a housing adapted to be supported on a flat horizontal surface and including an upper face facing upwardly of the housing when so supported;

a massaging unit mounted within the housing, said massaging unit including a plurality of elongated massaging elements each mounted so as to be rotatable about its longitudinal axis, said massaging elements being deployed in a radial pattern;

and a motor drive for cyclically rotating said massaging unit about an axis through the center of said radial pattern;

wherein each of said massaging elements has a substantially conical form.

5. The appliance according to claim 4, wherein each of said massaging elements is resiliently biased upwards.

6. A foot massaging appliance comprising:

a housing adapted to be supported on a flat horizontal surface and including an upper face facing upwardly of the housing when so supported;

at least one massaging unit mounted within the housing for cyclical movement;

and a motor drive for cyclically moving said massaging unit;

wherein said massaging unit includes a disc rotatable about a rotary axis central to said disc, and a plurality of massaging elements extending radially from the outer circumference of said disc towards its center, each of said massaging elements being rotatably mounted about its own rotary axis overlying said disc and extending radially thereof, and wherein said disc includes a further massaging element at its center, said further massaging element having an outer contour simulating an hour-glass to enable simultaneous massaging of the upper and lower surfaces of a user's foot.

* * * * *